US006176208B1

(12) United States Patent
Tsuzuki et al.

(10) Patent No.: US 6,176,208 B1
(45) **Date of Patent: *Jan. 23, 2001**

(54) ELECTROMAGNETIC VALVE DRIVING APPARATUS

(75) Inventors: Yoshihiro Tsuzuki, Handa; Fumiaki Arikawa, Okazaki, both of (JP)

(73) Assignee: Nippon Soken, Inc. (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/090,981

(22) Filed: Jun. 5, 1998

(30) Foreign Application Priority Data

Jul. 3, 1997 (JP) ..... 9-194885
Jul. 10, 1997 (JP) ..... 9-202502
Sep. 1, 1997 (JP) ..... 9-252892

(51) Int. Cl.[7] ..... F01L 9/04; F02B 25/00
(52) U.S. Cl. ..... 123/90.11; 251/129.01; 251/129.16
(58) Field of Search ..... 123/90.11; 251/129.01, 251/129.02, 129.05, 129.1, 129.16; 335/271, 277

(56) References Cited

U.S. PATENT DOCUMENTS 4,397,180 * 8/1983 Wolff et al. ..... 73/119 A
4,915,072 * 4/1990 Caron et al. ..... 123/357
5,197,439 * 3/1993 Gronenberg et al. ..... 123/506
5,239,961 * 8/1993 Neidhard et al. ..... 123/339.25
5,636,601 * 6/1997 Moriya et al. ..... 123/90.11
5,671,705 * 9/1997 Matsumoto et al. ..... 123/90.11
5,769,043 * 6/1998 Nitkiewicz ..... 123/90.11
5,782,211 * 7/1998 Kamimaru ..... 123/90.11

FOREIGN PATENT DOCUMENTS 7-332044 * 12/1995 (JP) .

* cited by examiner

*Primary Examiner*—Wellun Lo
(74) *Attorney, Agent, or Firm*—Nixon & Vanderhye PC

(57) ABSTRACT

An electromagnetic apparatus for driving a valve such as an intake valve of an internal combustion engine drives the valve to its closing position without generating vibration and noises which are detrimental to durability and reliability of the valve. The valve speed is controlled either mechanically or electrically so that it is reduced to substantially zero when the valve sits on a valve seat. To mechanically control the valve speed, air or magnetic liquid is used as a cushion against the valve movement, or springs having a non-linear spring modulus such as a double-spring or a barrel spring are used to bias the valve movement. To electrically control the valve speed, an electrical signal representing the valve position is used to determine energization timing of the solenoids which drive the valve to an open or closing position. Such electrical signal is generated by an eddy current, resistance or spring load detector.

11 Claims, 17 Drawing Sheets

ELECTROMAGNETIC VALVE DRIVING APPARATUS

CROSS-REFERENCE TO RELATED APPLICATIONS

This application is based upon and claims benefit of priority of Japanese Patent Applications No. Hei-9-194885 filed on Jul. 3, 1997, No. Hei-9-202502 filed on Jul. 10, 1997, and No. Hei-9-252892, filed on Sep. 1, 1997, the contents of which are incorporated herein by reference.

BACKGROUND OF THE INVENTION

1. Field of the Invention

The present invention relates to an electromagnetic valve driving apparatus, and more particularly to an electromagnetic apparatus for directly driving a valve used in an internal combustion engine, such as an intake valve, in which noises and vibration occurring when the valve is closed or opened are reduced.

2. Description of the Related Art

Electromagnetic apparatus for driving a valve used in an internal combustion engine have been known hitherto, and an example of this kind of apparatus is disclosed in JP-A-7-332044. The apparatus includes an armature fixed to a valve stem at its upper portion, a spring biasing the armature in a valve closing direction, another spring biasing the armature in a valve opening direction and an electromagnetic actuator. The valve is held at a neutral position by both springs when the electromagnetic actuator is not energized. The electromagnetic actuator includes an electromagnet for closing the valve (a closing solenoid) and another electromagnet for opening the valve (an opening solenoid), and it opens or closes the valve by attracting the armature. An example of relation between the valve positions and the valve speed in the conventional apparatus is shown in FIG. 18. To bring the valve from an open position to a closed position, the valve opening solenoid is deenergized, and thereby the valve is moved toward the closed position by the spring biasing the valve toward the closed position. Then, the valve closing solenoid is energized, and thereby the armature is attached to the valve closing solenoid and the valve is brought to the closed position. As shown in the graph at the bottom, the valve speed increases just before the closed position because magnetic force attracting the armature increases as an air gap between the armature and the closing solenoid becomes smaller. Then, the valve sits on the valve seat abruptly at the closed position, thereby generating vibration and noises. The vibration of the valve is detrimental to durability of the valve.

The valve speed at a vicinity of the closed position cannot be controlled in the conventional apparatus, and therefore, the abrupt sitting cannot be avoided.

SUMMARY OF THE INVENTION

The present invention has been made in view of the above-mentioned problem, and an object of the present invention is to provide an electromagnetic apparatus for driving the valve such as an intake or exhaust valve used in an internal combustion engine, in which vibration and noises generated when the valve sits on a valve seat are alleviated or eliminated by reducing the sitting speed of the valve. Thereby, durability and reliability of the valve are improved.

A rod for moving the valve between its closed position and open position is connected to the valve which is disposed in a valve body. The rod is biased toward the closed position by a first spring and toward the open position by a second spring. An armature disc made of a magnetic material is fixed in the middle portion of the rod. A first solenoid for moving the valve to the closed position is disposed above the armature, and a second solenoid for moving the valve to the open position is disposed under the armature. Two chambers or spaces are formed above and under the armature. When both solenoids are not energized, the valve connected to the rod maintains an intermediate position between the open and closed positions because the biasing forces of both first and second springs are balanced. When the first solenoid is energized, the armature is attracted thereto and the valve moves to the closed position. When the second solenoid is energized, the armature is attracted thereto and the valve moves to the open position.

If the valve hits a valve seat at a high speed when it comes to the closed position, harmful vibration and noises are generated. The valve speed at the closed position is reduced to substantially zero according to the present invention. The valve speed may be controlled mechanically or electrically.

To control the valve speed mechanically, fluid may be filled in both chambers above and under the armature and is used as a cushion. Air may be used as a cushion fluid, and an one-way check valve is disposed on the armature so that the air in the upper chamber is compressed when the valve is moving toward the closed position while the air in the lower chamber is not compressed when the valve is moving toward the open position. Preferably, small orifices are formed on the armature so that the air pressure does not accumulate in the upper chamber during repeated operation. Alternatively, magnetic fluid comprising lubricant oil and small particles of a magnetic material dispersed in the oil may be used as a cushion fluid. In this case, small orifices are formed on the armature so that the magnetic fluid in both chambers can communicate with each other with a certain flow resistance. It is also possible to dispose closed spaces containing air therein which functions as an air cushion against the valve movement.

The first and second springs each having a non-linear spring modulus may be used so that the spring force becomes higher when the valve approaches the closed or open position. Such non-linear modulus spring may be realized by using two springs, one having a longer free length and the other having a shorter free length disposed in the former spring. Alternatively, a single spring having a barrel shape may be used.

Also, the valve speed can be electrically controlled. A valve position detector for generating an electrical signal representing the valve position is employed in the apparatus, and energization timing of the solenoids is controlled based on the electrical signal. More particularly, the first solenoid which is energized to move the valve to the closed position is temporarily deenergized to reduce the valve speed when the valve comes to a vicinity of the closed position. After the valve speed is sufficiently reduced, substantially to zero, the first solenoid is again energized to hold the valve on the valve seat. The timing of energization or deenergization of the solenoids is determined based on the electrical signal from the valve position detector.

As the valve position detector, an eddy current detector, a resistance detector or a spring load detector may be used. An eddy current detector of a known type may be additionally assembled with the apparatus, or components such as the armature and the solenoids may be utilized as elements of the eddy current detector. In this case, the armature may function as a target of the eddy current detector, the first solenoid as a primary coil, and the second solenoid as a secondary coil. Alternatively, a separate coil which functions as the secondary coil of the eddy current detector may be disposed on the armature or the first solenoid. In case the resistance detector is used as the valve position detector, the resistance detector measures a resistance between the armature and the valve body which represents the valve position. Further, a spring load detector which measures the spring load of the second spring biasing the valve toward the opening position may be used.

According to the present invention, the valve speed is sufficiently reduced, and the valve can sit softly on the valve seat without generating harmful vibration and noises. In addition, the armature does not hit the second solenoid hard when the valve comes to the open position.

Other objects and features of the present invention will become more readily apparent from a better understanding of the preferred embodiments described below with reference to the following drawings.

DETAILED DESCRIPTION OF THE PREFERRED EMBODIMENTS

Figure 1A:
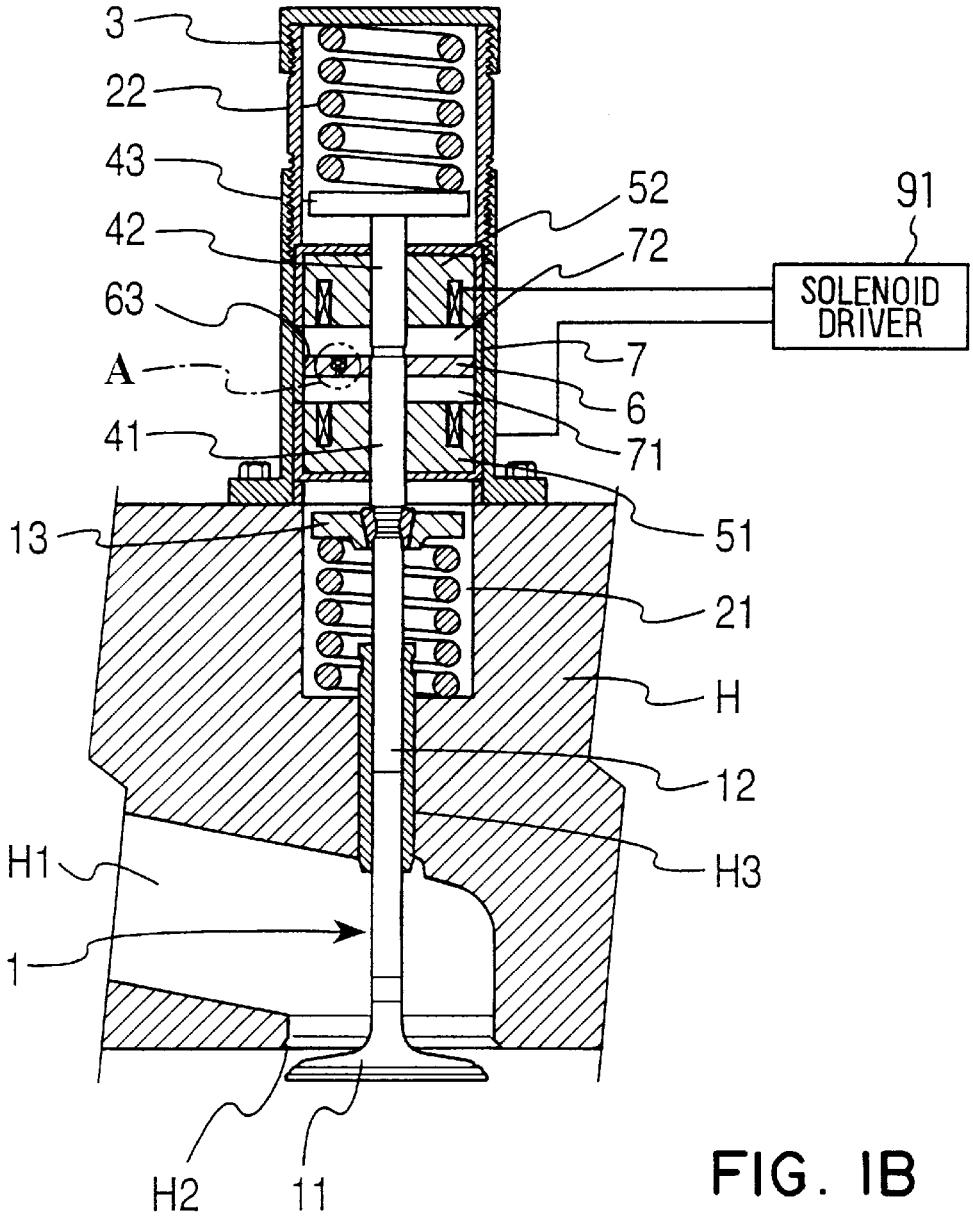
FIG. 1A is a cross-sectional view showing a whole structure of an electromagnetic valve driving apparatus as a first embodiment of the present invention.
Figure 1B:
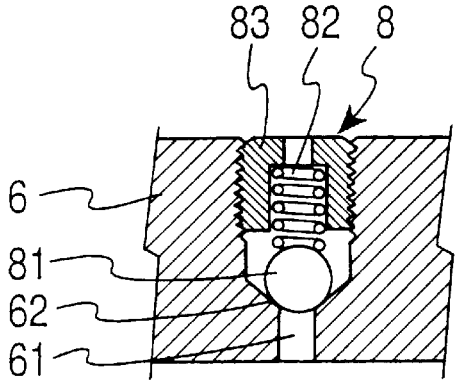
FIG. 1B is a fragmentary cross-sectional view showing a check valve used in the apparatus shown in FIG. 1A.

Referring to FIGS. 1A and 1B, a first embodiment of the present invention will be described. An electromagnetic valve driving apparatus is mounted on an engine head H. An intake port H1 is formed in the engine head H as shown in FIG. 1A. A valve 1 having a valve 11 and a valve stem 12 is installed in the engine head H for opening and closing the intake port H1. The valve 11 sits on a valve seat H2 when it closes the intake port H1 and leaves the valve seat H2 when it opens the intake port H1. The valve stem 12 is slidably inserted into a sleeve H3. A spring stopper 13 is fixed to the top end of the valve stem 12, and a cavity is formed on the top portion of the head H. A lower spring 21 is disposed in the cavity and held between the spring stopper 13 and the bottom of the cavity, so that the lower spring 21 biases the intake valve 1 in the direction to lift up the valve 11 and to close the intake port H1.

A cylindrical housing 3 having a closed top end and an open bottom end is fixedly mounted on the top surface of the engine head H. A cylindrical spacer 7 is fixedly disposed in the housing 3. A lower solenoid 51 and an upper soleniod 52 are held in the spacer 7 with a space therebetween. A lower push rod 41 having an armature disc 6 fixed at its top end is slidably held in the lower solenoid 51. The lower push rod 41 abuts with the top end of the valve stem 12. An upper push rod 42 having a spring stopper 43 fixed at its top end is slidably held in the upper solenoid 52 and abuts with the top end of the lower push rod 41 at its bottom end. Both lower and upper solenoids are electrically connected to a solenoid driver 91. An upper spring 22 is disposed between the spring stopper 43 and the closed top end of the housing 3, so that the upper spring 22 biases the intake valve 1 in the direction to lower the intake valve 1 and to open the intake port H1. The armature 6 is located in the space between the lower solenoid 51 and the upper solenoid 52, forming a lower chamber 71 and an upper chamber 72.

The biasing force of both springs 21, 22 is set at an equal value, and the armature 6 takes a position which is substantially a center of the space between solenoids 51 and 52 when neither solenoid is energized. When the lower solenoid 51 is energized by the solenoid driver 91, the armature 6 is attracted to the lower solenoid 51, and thereby the valve 1 is lowered and the intake port H1 is opened. When the upper solenoid 52 is energized, the armature 6 is attracted to the upper solenoid 52, and thereby the valve 1 is lifted and the intake port H1 is closed.

Since the lower and upper solenoids 51, 52 are contained in the spacer 7, the space between solenoids is constant, and an amount of valve movement (a valve lift) is defined by the space. The lower and upper spaces 71, 72 are filled with air. A check valve 8, which permits an one-way air flow from the lower chamber 71 to the upper chamber 72 and prevents air flow from the upper chamber 72 to the lower chamber 71, is disposed in the armature disc 6. A check valve portion "A" in FIG. 1A is shown in FIG. 1B in an enlarged scale. The check valve 8 is composed of a passage 61 having a tapered seat 62, a ball 81, a spring 82 and a screw 83. The ball 81 is pushed down against the tapered seat 62 by the spring 82 which is held in the passage 61 by the screw 83. Also, a small orifice 63 is formed at the outer periphery of the armature disc 6.

Now, the operation of the electromagnetic valve driving apparatus described above will be explained. Since the armature disc 6 takes a middle position and the valve 11 is half open when the apparatus is not operated, the valve 11 has to be once brought to the closed position before the engine is started. This setting up operation is performed by imposing a voltage, which has a frequency equal to a natural frequency determined by mass and spring force of a moving unit, alternately on the lower and upper solenoids 51, 52. After a certain period of time during which this voltage is imposed, the valve 1 starts to vibrate, and the vibration amplitude becomes larger. Soon after that, the amplitude becomes a maximum value which is determined by the space between the lower and upper solenoids 51, 52. When the armature disc 6 reaches the position of the upper solenoid 52, the armature disc 6 is held attracted to the upper solenoid 52, bringing the intake valve 1 to the closed position. This completes the setting-up operation. After the setting-up operation is completed, the engine is started, and the closing and opening of the intake valve 1 are controlled according to signals sent to the solenoid driver 91 from various sensors.

The operation of the check valve 8 will be described below. To bring the intake valve 1 to the closing position from the open position (where the armature disc 6 is attracted to the lower solenoid 51), the lower solenoid 51 is first deenergized. At this moment, the compressed lower spring 21 expands and the intake valve 1 starts to move upward. According to this upward movement, the valve stem 12 pushes up the lower push rod 41 carrying the armature disc 6 on its top end. As the armature disc 6 moves upward, the volume of the upper chamber 72 is gradually decreased, compressing air in the upper chamber 72 because the check valve 8 does not permit the air flow from the upper chamber 72 to the lower chamber 71. In other words, the air in the upper chamber 72 functions as an air damper to decrease the valve speed when the intake valve 1 is about to sit on the valve seat H2. The closer the intake valve 1 comes to the valve seat H2, the higher the damping force becomes, because the damping force in the upper chamber 72 is dependent on the air pressure in the upper chamber 72. When the intake valve 1 is about to sit on the valve seat H2, the upper solenoid 52 is energized and attracts the armature disc 6 thereon to keep the intake valve 1 at the closed position. Because of the damping force, the intake valve 1 sits on the valve seat H2 softly without generating vibration and noises. In other words, impact force caused by collision of the intake valve 1 with the valve seat H2 is greatly reduced by the damping force of air in the upper chamber 72.

To bring the intake valve 1 to the open position from the closed position, the upper solenoid 52 is first deenergized. At this moment, the compressed upper spring 22 expands, and the armature disc 6 and the intake valve 1 move downward. The armature disc 6 can move downward smoothly because the check valve 8 opens and the air in the lower chamber 71 flows into the upper chamber 72 through the check valve 8.

The small orifice 63 formed on the periphery of the armature disc 6 functions to relieve the high pressure in the upper chamber 72 which otherwise becomes excessively high by repeating the pumping action of the armature disc 6. It is preferable to equalize the pressure both in the upper and lower chambers 72, 71 while the apparatus is not in operation by leading the air in the upper chamber 72 to the lower chamber 71 through the small orifice 63. The orifice 63 may be replaced by a small hole formed through the armature disc 6.

Though the present invention is described as being applied to the apparatus for driving the intake valve, it is also applicable to an apparatus for driving an exhaust valve in the same manner as above.

Figure 2:
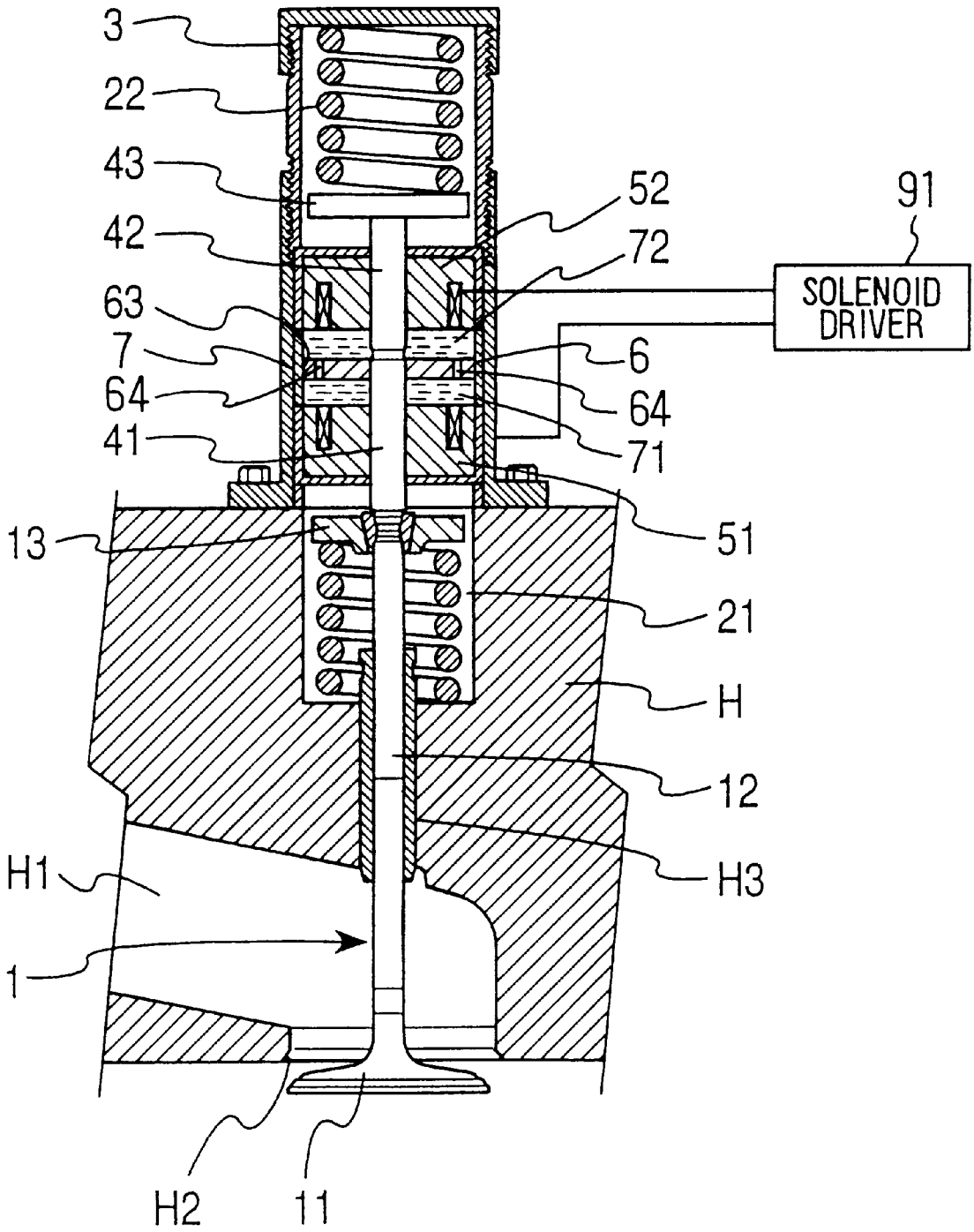
FIG. 2 is a cross-sectional view showing a whole structure of an electromagnetic valve driving apparatus as a modification of the first embodiment.

Referring to FIG. 2, a modified form of the first embodiment will be described. In this modification, magnetic liquid is filled in the lower and upper chambers 71, 72 in place of air in the first embodiment. The magnetic liquid is composed of liquid as a medium and small particles made of a magnetic material dispersed in the liquid. It is preferable to use lubricant liquid as the medium liquid to enhance lubrication of sliding movement of the armature disc 6. Plural small passages 64 through which the magnetic liquid in both chambers communicates are formed on the armature disc 6. Preferably, the small passages 64 are uniformly distributed on the armature disc 6 to make the magnetic liquid flow uniform. Other structures of the apparatus are all the same as those of the first embodiment. Therefore, the same parts and components of the apparatus are numbered with the same numbers, and detailed explanation is not repeated here.

When the armature disc 6 moves in the space between the lower and upper solenoids 51, 52, the magnetic liquid filled in both cambers 71, 72 functions as a damper in the similar manner as in the first embodiment. Therefore, the valve 11 sits softly on the valve seat H2 without generating vibration and noises when it is brought to the closing position. The cross-sectional area of the small passages 64 is selected in relation with the viscosity of the magnetic liquid, so that the magnetic liquid gives a proper damping force. Because the magnetic liquid is used in this modification in place of air in the first embodiment, magnetic flux density increases and magnetic force of the solenoids to attract the armature disc 6 becomes larger.

Figure 3:
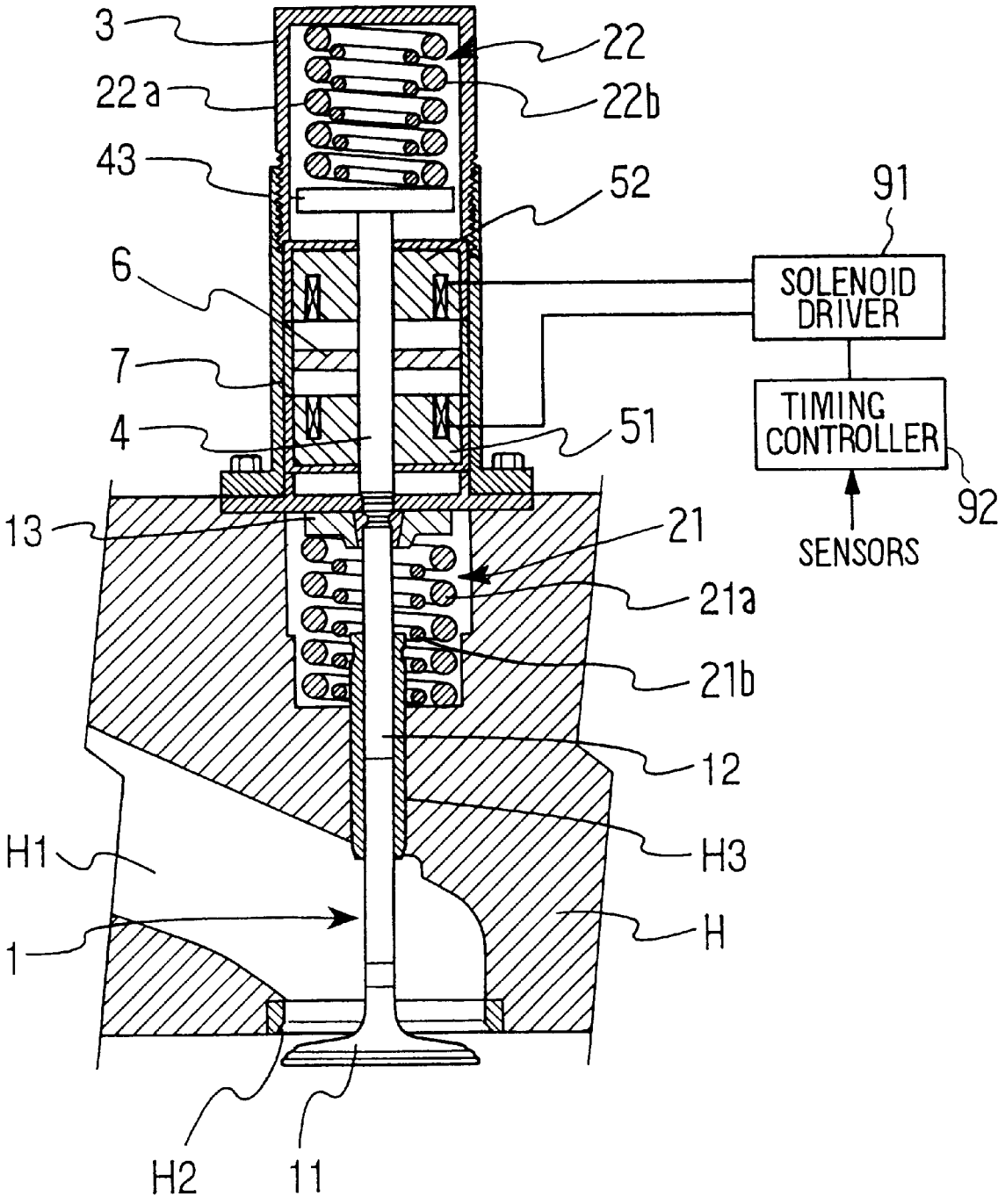
FIG. 3 is a cross-sectional view showing a whole structure of an electromagnetic valve driving apparatus as a second embodiment of the present invention.
Figure 4:
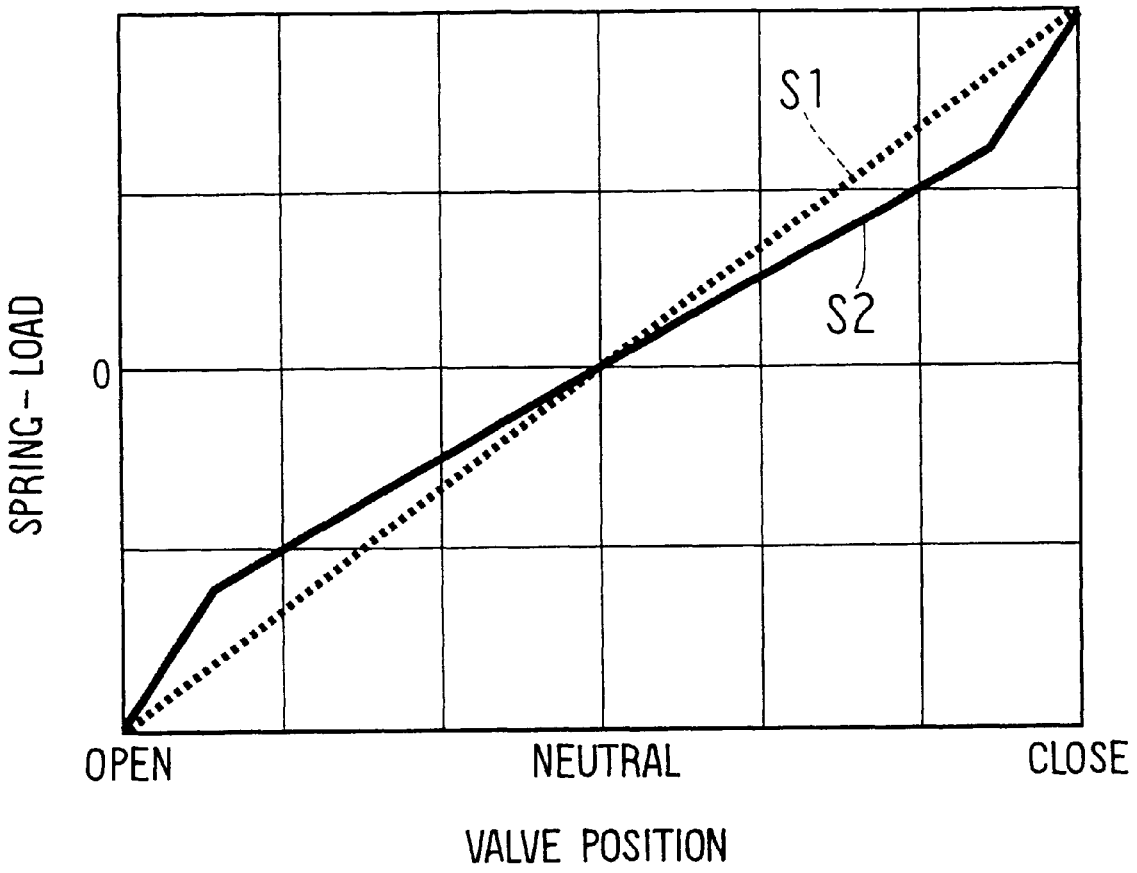
FIG. 4 is a graph showing the relation between the valve position and the spring load in the second embodiment.

Referring to FIGS. 3 and 4, a second embodiment of the present invention will be described. In this embodiment, the lower spring 21 is composed of an outer spring 21*a* and an inner spring 21*b*, and the upper spring 22 is composed of an outer spring 22*a* and an inner spring 22*b*. The lower push rod 41 and the upper push rod 42 in the first embodiment are combined into a single push rod 4. No air or liquid is filled in the chambers 71 and 72, and the check valve 8 is not disposed on the armature disc 6 in the second embodiment. Other structures are the same as those of the first embodiment.

The inner spring 21*b* having a smaller spring modulus and a shorter length than the outer spring 21*a* is inserted in the outer spring 21*a*. Both outer and inner springs 21*a*, 21*b* constitute the lower spring 21. Similarly, the inner spring 22*b* having a smaller spring modulus and a shorter length than the outer spring 22*a* is inserted in the outer spring 22*a*. Both outer and inner springs 22*a*, 22*b* constitute the upper spring 22. Both outer springs 21*a* and 22*a* have a same spring modulus, and both inner springs 21*b* and 22*b* have a same spring modulus.

When both lower and upper solenoids 51, 52 are not energized, the armature disc 6 stays in the middle of the space between the solenoids. The armature disc 6 is driven downward or upward by energizing either one of the solenoids. The solenoids are driven by the solenoid driver 91 to which timing signals are fed from a timing controller 92. Signals from various sensors including a piston position sensor are fed to the timing controller 92. To bring the intake valve 1 to the closing position, the upper solenoid 52 is energized to attract the armature disc 6 thereto. At this instance, the outer spring 22*a* of the upper spring 22 is first compressed. As the armature disc 6 moves upward and comes closer to the upper solenoid 52, the valve speed increases because the solenoid force for attracting the armature disc becomes higher. When the armature disc 6 is about to contact the upper solenoid 52 (the valve 11 is about to sit on the valve seat H2), the inner spring 22*b* of the upper spring 22 contacts the upper end of the housing 3 and exerts its spring force on the spring stopper 43. In other words, both springs 22*a* and 22*b* work together at this moment, and accordingly the valve speed is decreased. Therefore, the valve 11 can sit softly on the valve seat H2 without generating vibration and noises. Similarly, when the armature disc 6 is attracted to the lower solenoid 51 and the armature disc 6 is about to contact the lower solenoid 52, the inner spring 21*b* of the lower spring 21 works cooperatively with the outer spring 21*a*, thereby reducing the speed of the armature disc 6. Thus, the noise otherwise caused by hitting the lower solenoid 51 can be reduced.

The spring-load of a double spring arrangement described above is shown in FIG. 4 in comparison with that of a single spring arrangement. The spring-load on the ordinate versus the valve position on the abscissa is shown in the graph of FIG. 4. The line S1 shows the spring-load when the lower and upper springs 21, 22 include no inner springs (a single spring arrangement), and the line S2 shows the spring-load when both springs include respective inner springs 21*b*, 22*b* as in the second embodiment. The spring-load S1 changes linearly in a whole range of the valve position, while the spring-load S2 shows a gradient change at the vicinity of the open and closing positions. In the double spring arrangement, when the valve 11 is about to come to the closed position, the spring-load of the inner spring 22*b* is added, and accordingly the spring-load gradient increases as shown by the line S2. Since the total spring-load at the vicinity of the closed position is set to be equal to the magnetic force of the upper solenoid 52, the valve speed becomes almost zero at the closed position. Therefore, the valve 11 sits softly on the valve seat H2 without generating vibration and noises. Similarly, when the armature disc 6 is about to contact the lower solenoid 51 in the valve opening process, the additional spring force of the inner spring 21*b* is added, and accordingly the armature disc 6 contacts the lower solenoid 51 softly without generating vibration and noises. Though two springs are arranged in parallel in the embodiment described above, it is also possible to arrange two springs in series, so that a spring having a lower spring modulus works first and then a spring having a higher spring modulus works.

Figure 5:
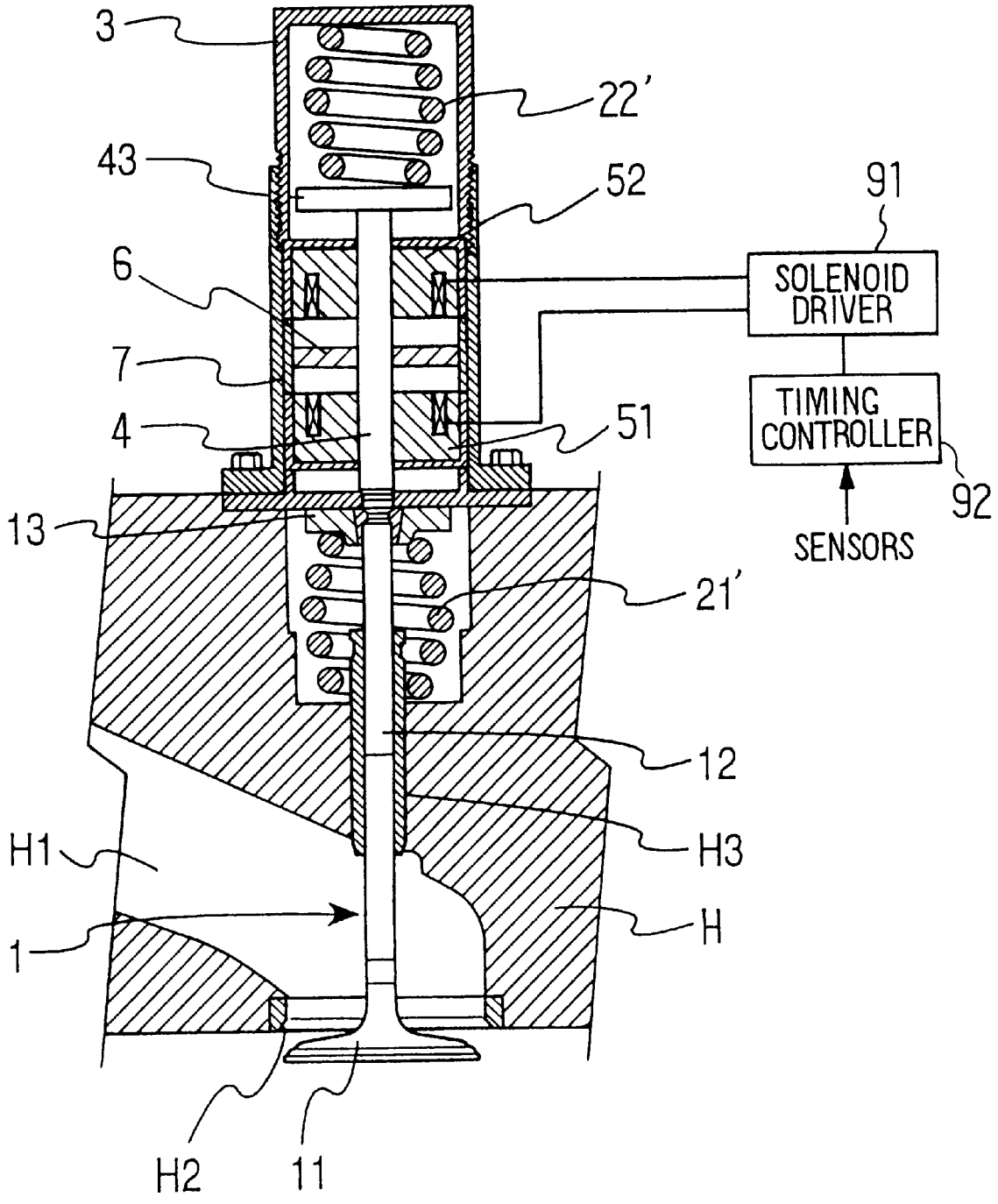
FIG. 5 is a cross-sectional view showing a whole structure of an electromagnetic valve driving apparatus as a modification of the second embodiment.

FIG. 5 shows a modified form of the second embodiment in which a barrel-shaped lower spring 21' and a barrel-shaped upper spring 22' are used in place of the double springs 21, 22. The barrel-shaped springs 21', 22' have a non-linear spring modulus, so that the spring force gradually increases as the valve 11 approaches the open or closing position. This arrangement also performs the function to slow down the valve speed as the valve comes close to the closed position or the open position. The spring is not limited to the barrel-shaped spring but it may have variable forms, for example, a coil spring having an unequal coil diameter, as long as the spring performs the function to decrease the valve speed when the valve approaches the open or closed position.

Figure 6:
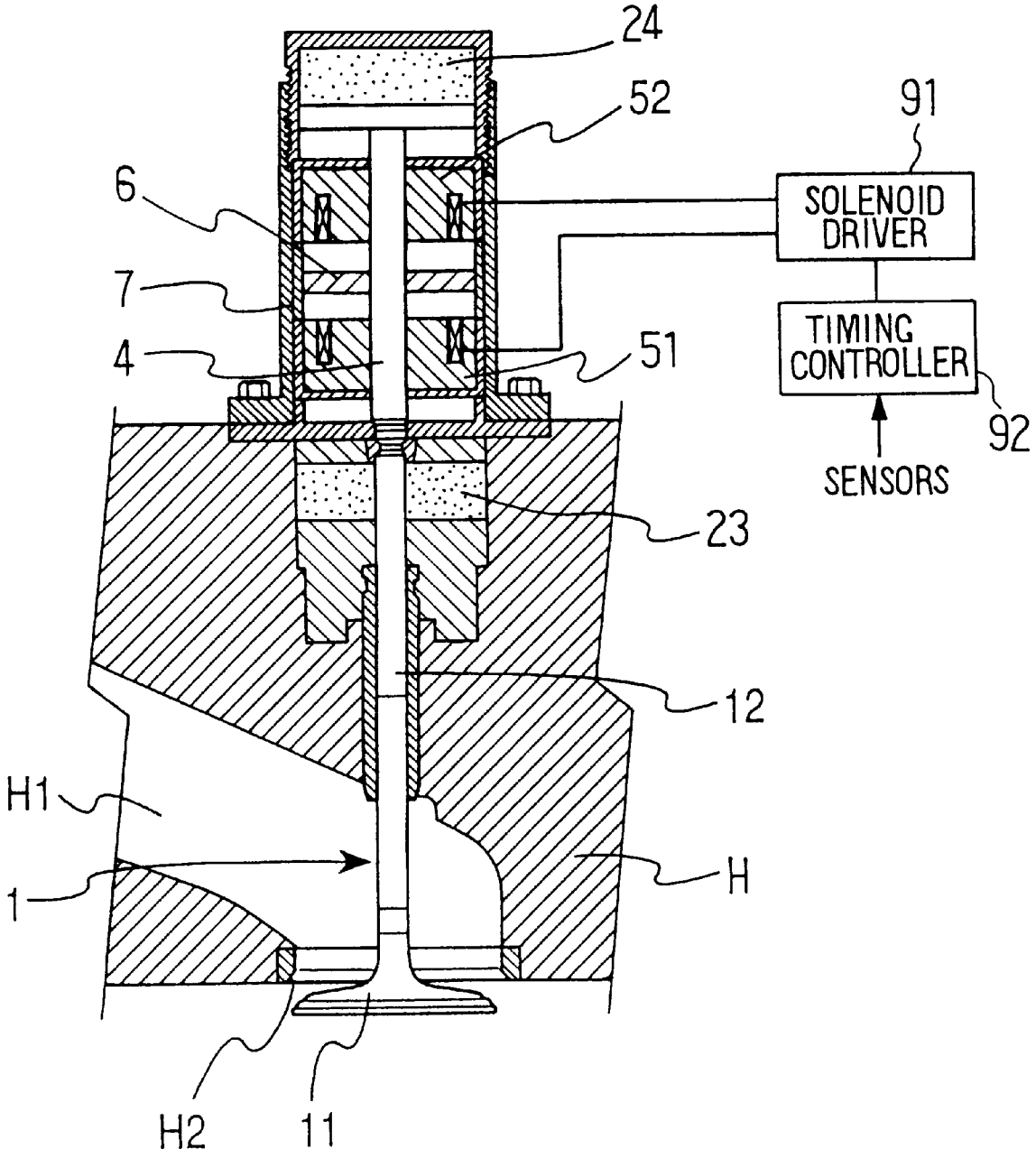
FIG. 6 is a cross-sectional view showing a whole structure of an electromagnetic valve driving apparatus as a third embodiment of the present invention.

FIG. 6 shows a third embodiment of the present invention, in which a lower closed space 23 and an upper closed space 24 are formed in place of the lower spring 21 and the upper spring 22. Air is filled in both closed spaces 23 and 24, and is compressed when the volume of the respective closed space is decreased according to the movement of the intake valve 1. The air contained in the closed spaces 23, 24 functions as a damper to slow down the valve speed. Since the smaller the closed space becomes, the higher the pressure therein becomes, a higher damping force is given to the intake valve 1 at the vicinity of its closed or open position. Thus, the valve 11 can sit on the valve seat H2 smoothly and softly.

Figure 7:
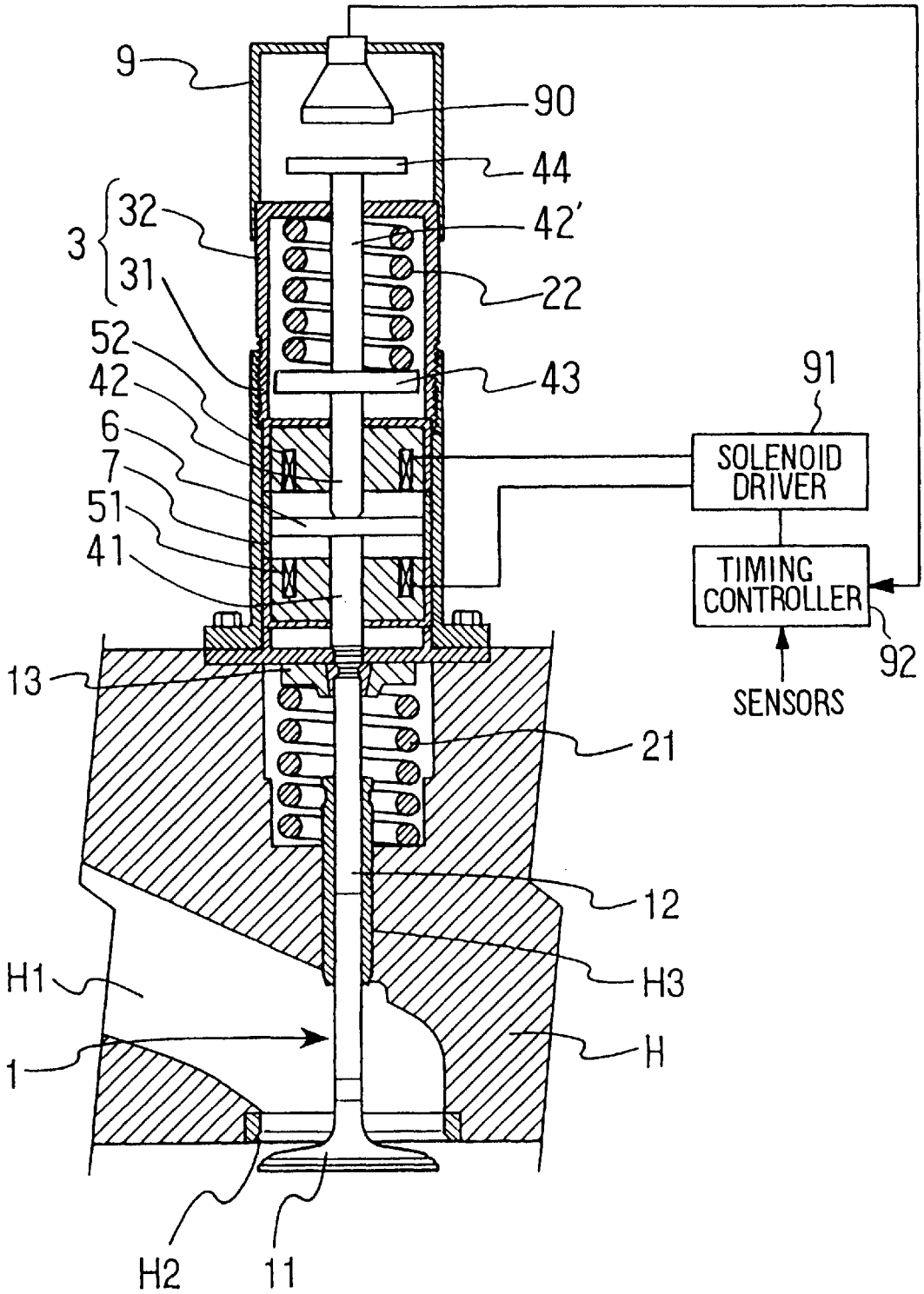
FIG. 7 is a cross-sectional view showing a whole structure of an electromagnetic valve driving apparatus as a fourth embodiment of the present invention.
Figure 8A:
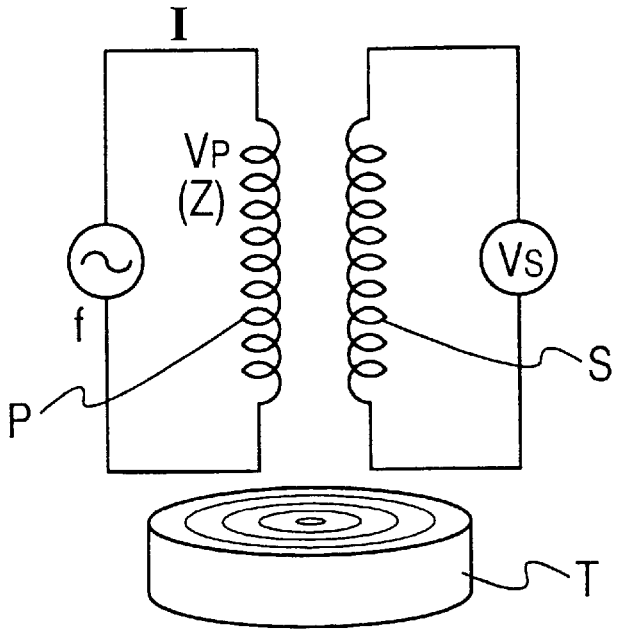
FIGS. 8A–8C show details of a valve position detecting sensor used in the fourth embodiment.
Figure 8B:
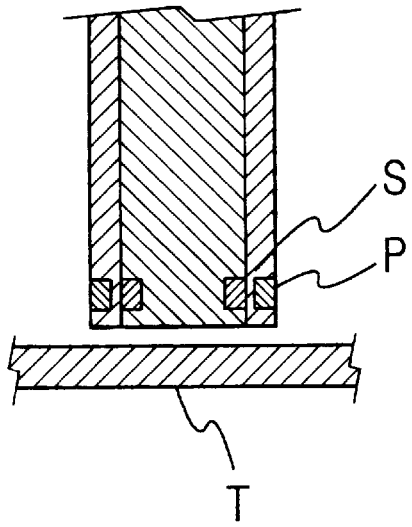
Figure 8C:
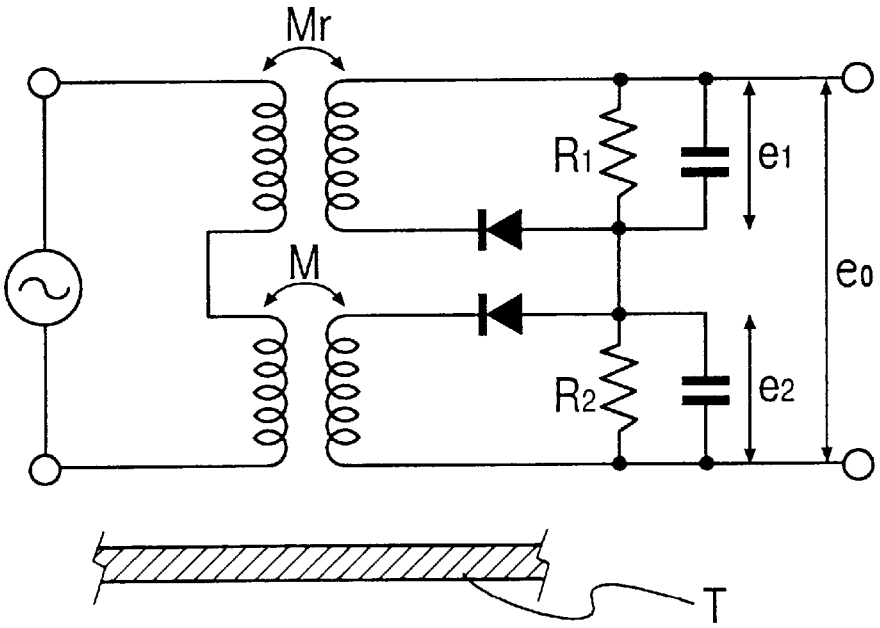
Figure 9:
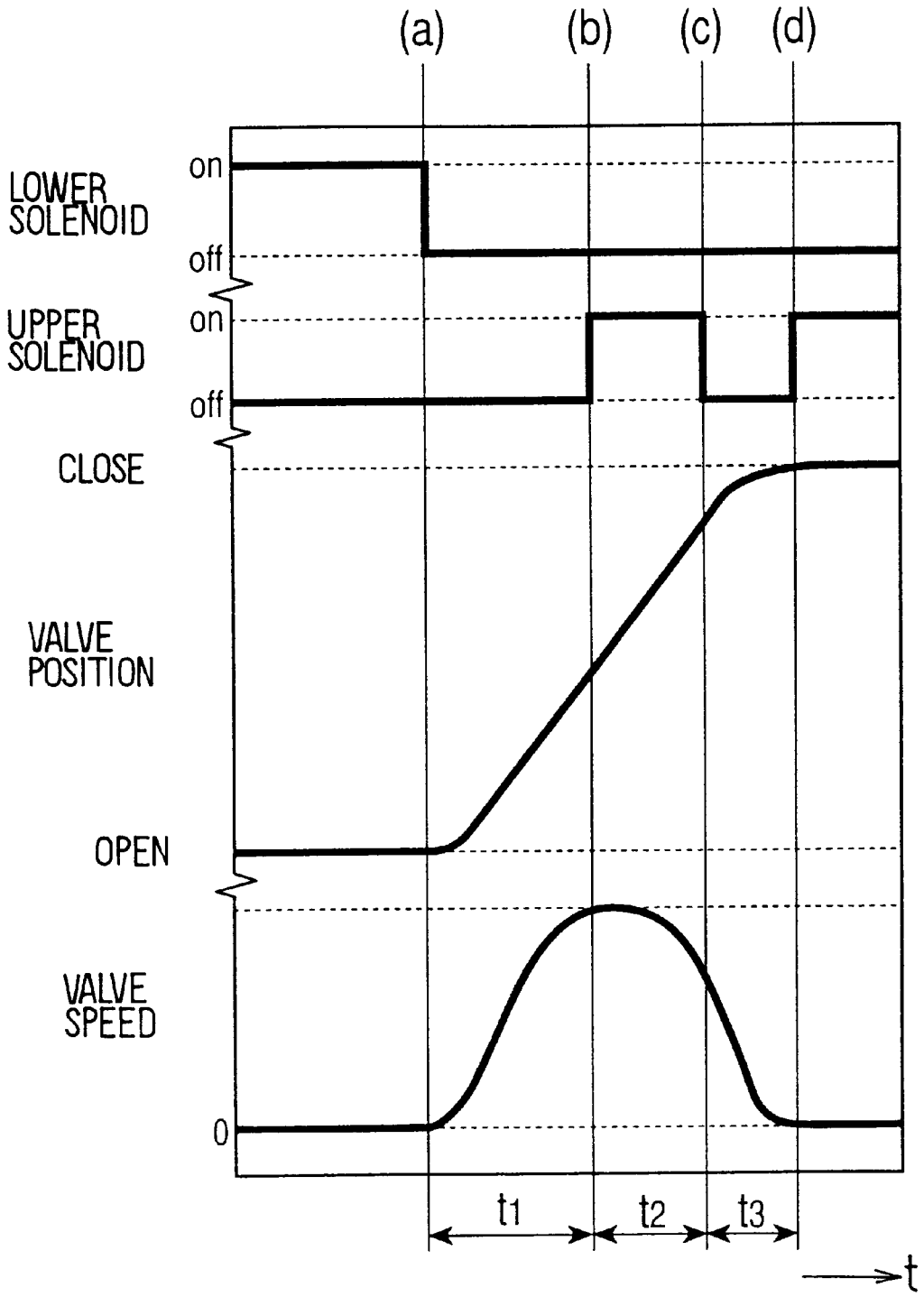
FIG. 9 is a graph showing the valve speed, the valve position and energization timing of solenoids used in the fourth embodiment.

Referring to FIGS. 7 to 9, a fourth embodiment of the present invention will be described. In this embodiment, an upper housing 9 containing therein a valve position detecting sensor 90 is added on the top of the housing 3 having a lower portion 31 and an upper portion 32. The valve position is detected by the sensor 90, and electrical signals from the sensor 90 are fed to the timing controller 92 which in turn controls the solenoid driver 91. The valve speed is controlled electrically depending on the signals of the valve position detecting sensor 90 in this embodiment, as opposed to the valve speed control performed mechanically by springs or dampers in the foregoing embodiments. Other structures are similar to those of the foregoing embodiments (the same components are numbered with the same numbers).

An additional push rod 42' is sticking out from the top end of the housing 3, and a metallic disc 44 is fixed to the top end of the push rod 42'. The valve position detecting sensor 90 is disposed on the top end of the upper housing 9 and faces the metallic disc 44 with a certain air gap. The sensor 90 detects eddy current generated in the metallic disc 44 which acts as a target plate of the sensor 90.

Though the sensor 90 detecting eddy current is a known type, the operation thereof will be briefly explained, referring to FIGS. 8A to 8C. The sensor 90 includes a transformer having a primary winding P and a secondary winding S. An alternating current source is connected to the primary coil P, and voltage Vs of the secondary coil S is used as a signal representing the distance between the sensor 90 and the metallic disc 44 as a target T. As the target T approaches the sensor 90, eddy current is generated in the target T by an alternating magnetic field of the primary coil P (a primary field). The eddy current in the target T generates a secondary field the direction of which is opposite to the primary field. The secondary field weakens the primary field. In other words, a mutual inductance between the primary coil P and the secondary coil S is changed. This change is detected as a change of the output Vs of the secondary coil S. A cross-sectional view of the sensor 90 and the target T is shown in FIG. 8B. FIG. 8C shows another form of the sensor 90 that detects the distance of the target T from the sensor 90 more precisely, in which a pair of transformers having respective mutual inductances Mr, M are connected in a bridge form. A pair of diodes, resistors R1, R2 and capacitors are connected to the secondary coils as shown in FIG. 8C. Voltage e0 is used as a signal representing the valve position.

The output signal from the valve position detecting sensor 90 is fed to the timing controller 92 together with signals from other sensors including a piston position detecting sensor (not shown in the drawings). The timing controller 92 calculates timing for energizing the solenoids 51, 52 based on those signals fed thereto and sends the timing signal to the solenoid driver 91. The valve speed is controlled by properly setting the timing to energize the solenoids 51, 52 in this embodiment. Details of such timing will be explained with reference to FIG. 9.

Figure 18:
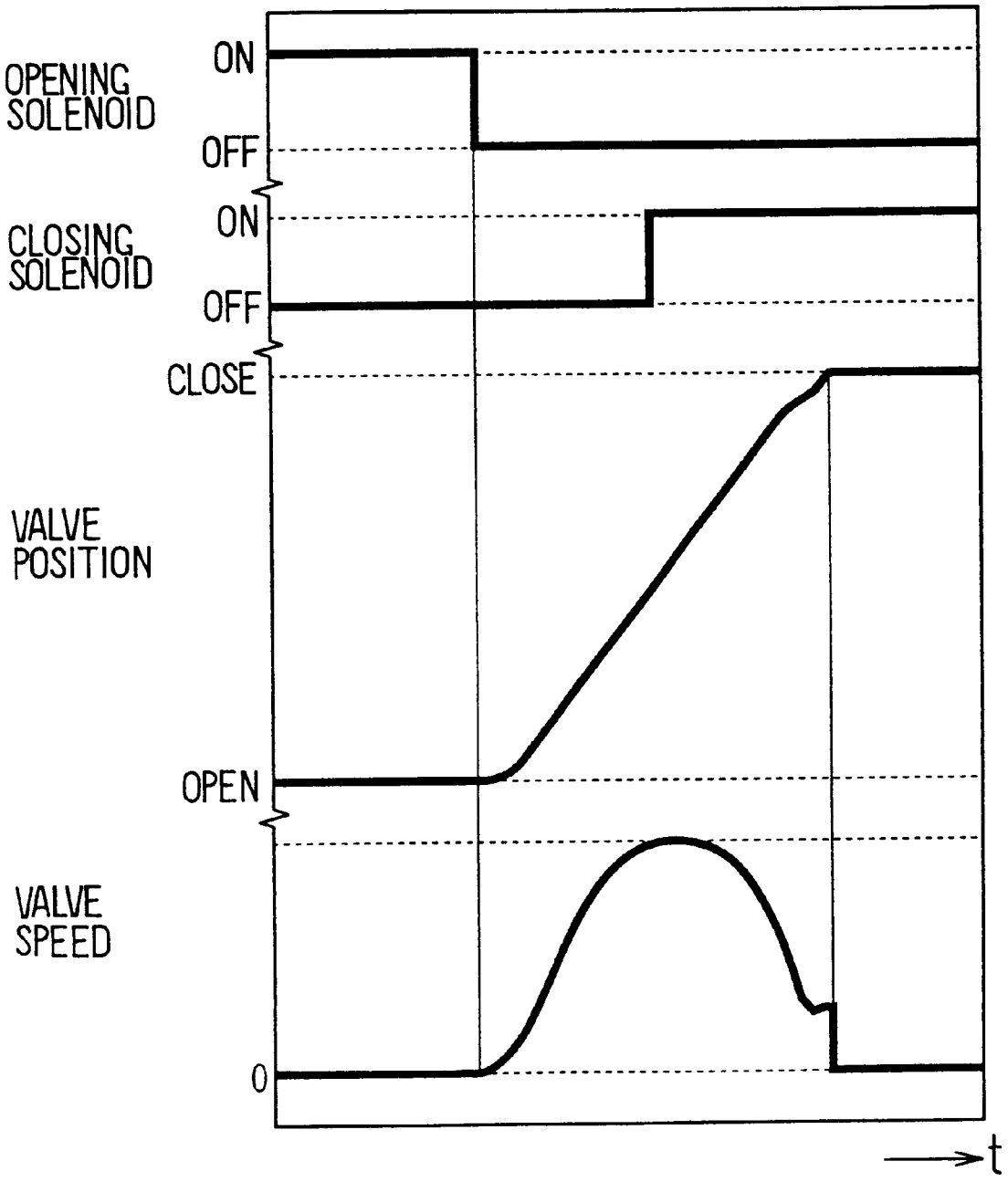
FIG. 18 PRIOR ART
FIG. 18 is a graph showing the relation between energization timing of solenoids, valve positions and valve speed in a conventional electromagnetic valve driving apparatus.

Graphs in FIG. 9 show energization timing of the lower solenoids 51 and the upper solenoid 52, the valve position, and the valve speed, respectively, when the intake valve 1 is driven from the open position to the closed position. At the open position, the lower solenoid 51 is energized and the armature disc 6 is attracted to the lower solenoid 51. To drive the intake valve 1 to the closing position, the lower solenoid 51 is deenergized at a point (a) in FIG. 9. From this point, the intake valve 1 is pushed up by the compressed spring force of the lower spring 21, and the valve speed gradually increases. When the intake valve 1 passes the middle point, the valve speed starts to decrease because of frictional force given to sliding parts such as the stem 12 and the push rods 41, 42. At this point (b), the upper solenoid 52 is energized to exert force to attract the armature disc 6 thereto. If the upper solenoid 52 is continuously energized up to the point where the armature disc 6 contacts the upper solenoid 52, the valve speed will become high as shown in FIG. 18 (prior art), which generates undesirable vibration when the valve 1 sits on the valve seat H2 at the closed position. To avoid the valve speed increase at the vicinity of the closed position, the upper solenoid 52 is deenergized at point (c) which is detected by the valve position detecting sensor 90. The intake valve 1 approaches the closed position by the spring force of the lower spring 21, decreasing its speed gradually as shown in the bottom graph in FIG. 9. At position (d), just before the closed position, the upper solenoid 52 is energized again to attract the armature disc 6 to the upper solenoid 52 and to hold it at the closed position. Thus, the valve 11 can sit softly on the valve seat H2.

The upper solenoid 52 is energized at a lapse of time t1 after the lower solenoid 51 is deenergized. The time period t1 has to be chosen properly, not too short and not too long. If it is too short, the magnetic force of the upper solenoid 52 is not used effectively because a distance from the armature disc 6 to the upper solenoid 52 is too far to attract the armature disc 6 to the upper solenoid 52, and accordingly electric power is consumed unnecessarily. On the other hand, if the time period t1 is too long, too much time is required to bring the intake valve 1 to the closed position because the armature disc 6 starts to be attracted to the upper solenoid 52 after the valve speed has been slowed down. Therefore, the upper solenoid 52 is energized at point (b) where the valve speed reaches its maximum in this embodiment. Also, a time period t2 during which the upper solenoid 52 is energized has to be properly chosen. If the time period t2 is too short, the upper solenoid 52 cannot attract the armature disc 6 close enough. If the time period t2 is too long, the armature disc 6 collides with the upper solenoid 52 with a high speed. Therefore, the time period t2 is chosen so that it ends when the armature disc 6 comes to a position with a proper distance from the upper solenoid 52. In this embodiment, the distance is chosen to be less than 5 $\mu$m. A time period t3 during which the upper solenoid 52 is deenergized is chosen so that it ends when the valve speed becomes substantially zero.

Figure 10:
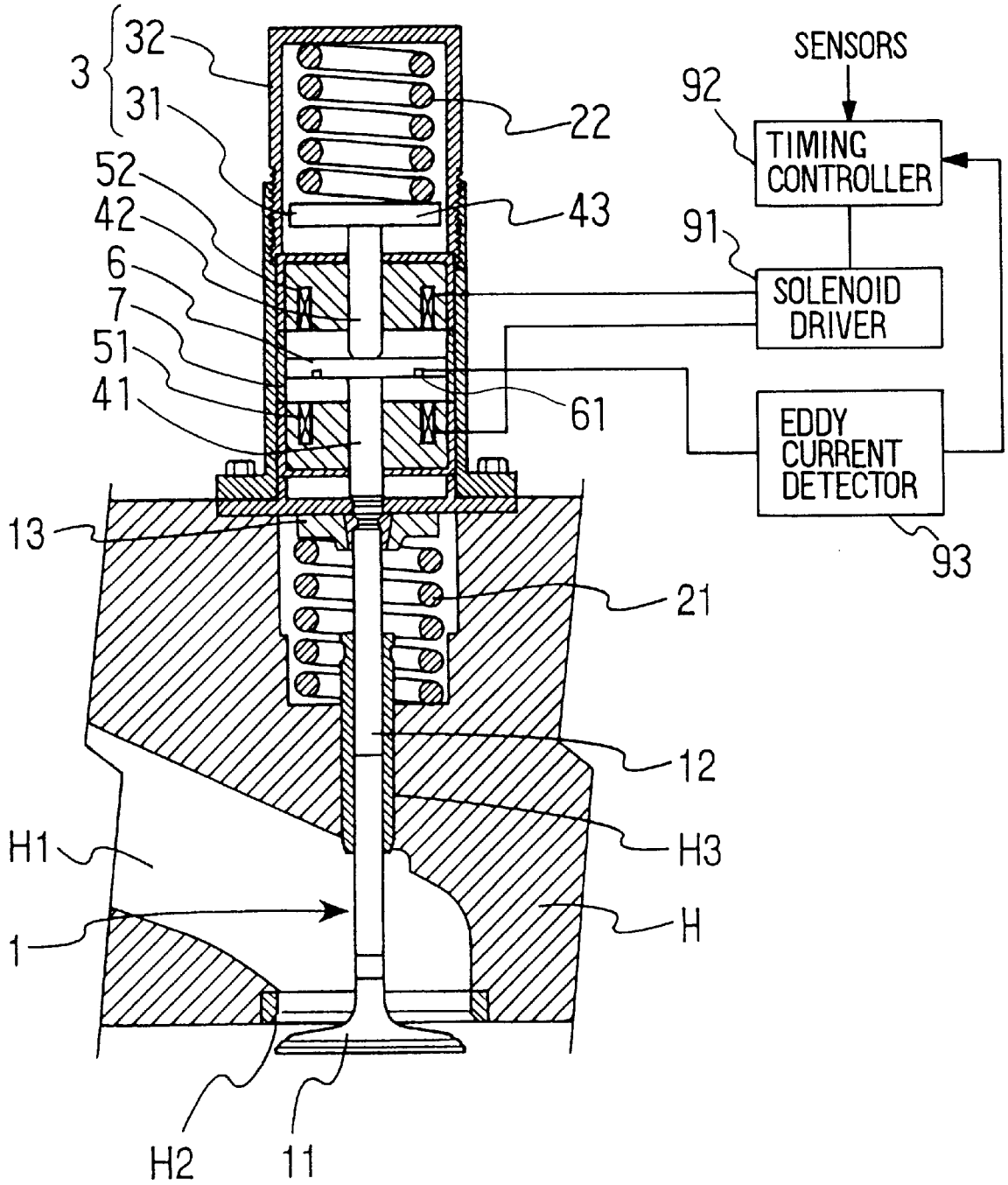
FIG. 10 is a cross-sectional view showing a whole structure of an electromagnetic valve driving apparatus as a fifth embodiment of the present invention.
Figure 11:
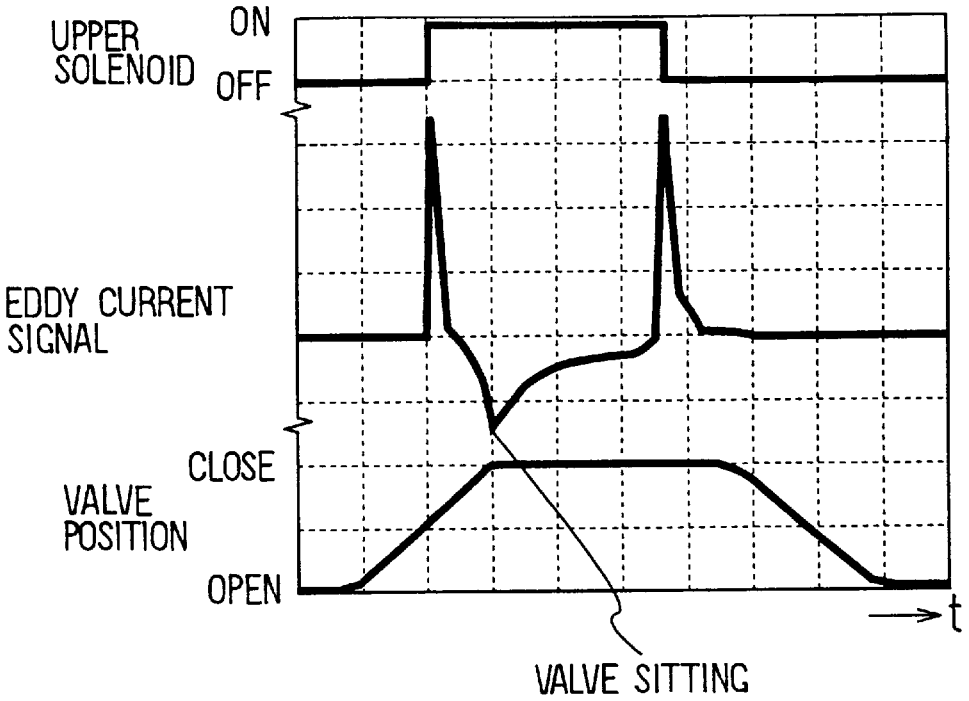
FIG. 11 is a graph showing the relation between the valve position and the eddy current signal generated in an eddy current detector used in the fifth embodiment, when an upper solenoid is not controlled according to the present invention.
Figure 12:
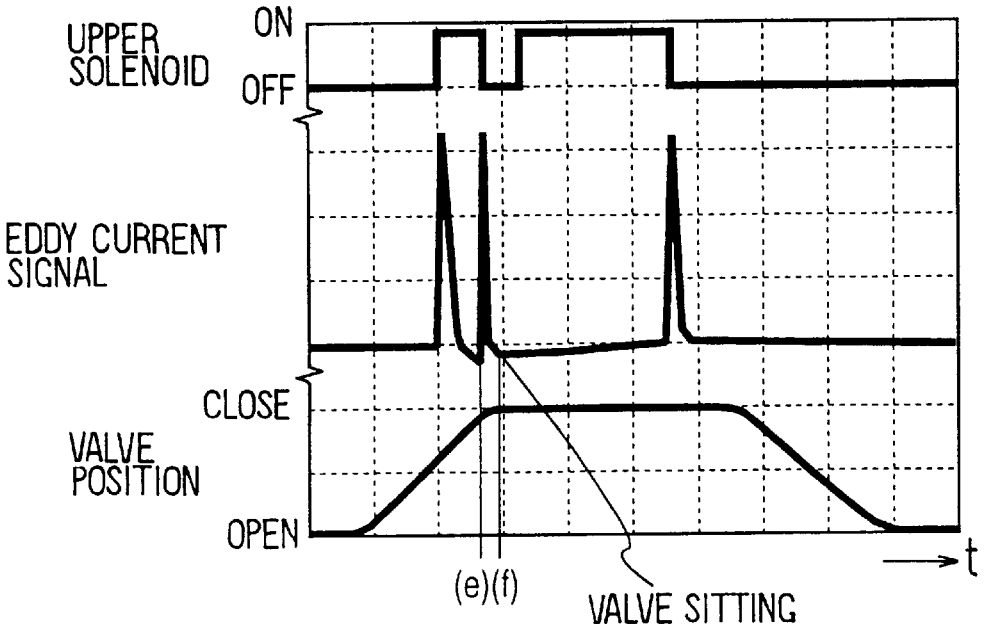
FIG. 12 is a graph similar to that shown in FIG. 11, when the upper solenoid is controlled according to the present invention.

Referring to FIGS. 10, 11 and 12, a fifth embodiment of the present invention will be described. In this embodiment, the valve position detecting sensor 90 of the fourth embodiment is replaced by an eddy current detector 93, and other structures are same as those of the fourth embodiment. The eddy current detector 93 includes an eddy current detecting coil 61 disposed on the armature disc 6 which functions as a secondary coil of the eddy current detector. The upper solenoid 52 functions as a primary coil of the eddy current detector, and the armature disc 6 as a target disc. The valve position is detected by the eddy current detector 93, and energization timing of the upper solenoid is controlled based on the valve position detected in the similar manner as in the fourth embodiment.

The eddy current detecting coil 61 of the fifth embodiment is constituted by three turns of a wire having a diameter of 0.1 mm. Graphs in FIG. 11 show energization timing of the upper solenoid 52 which is not controlled according to the valve position, a signal from the eddy current detector 93 and the valve position, respectively. As seen in the middle graph in FIG. 11, a peak of the eddy current signal appears when the valve 11 sits on the valve seat H2. This means that the valve speed is high at its closed position. FIG. 12 shows the same as FIG. 11 when the energization of the upper solenoid 52 is controlled according to the valve position detected by the eddy current detector 93. That is, the upper solenoid 52 is deenergized at point (e) before the closed position and energized again thereafter in the similar manner as in the fourth embodiment. By controlling the energization of the upper solenoid 52 in this manner, the peak of the eddy current signal at the closed position at point (f) disappears. This means that the valve speed at the closed position is sufficiently low. In the actual operation, the timing of deenergizing the upper solenoid 52 is determined according to the eddy current signal representing the valve position so that the peak of the eddy current signal at the closed position disappears. Thus, the valve 11 sits softly on the valve seat H2 without generating harmful vibration and noises. Since the valve position detector 90 used in the fourth embodiment is eliminated and replaced by the eddy current detecting coil 61 disposed on the armature disc 6, the whole apparatus can be made more compact in size.

Figure 13:
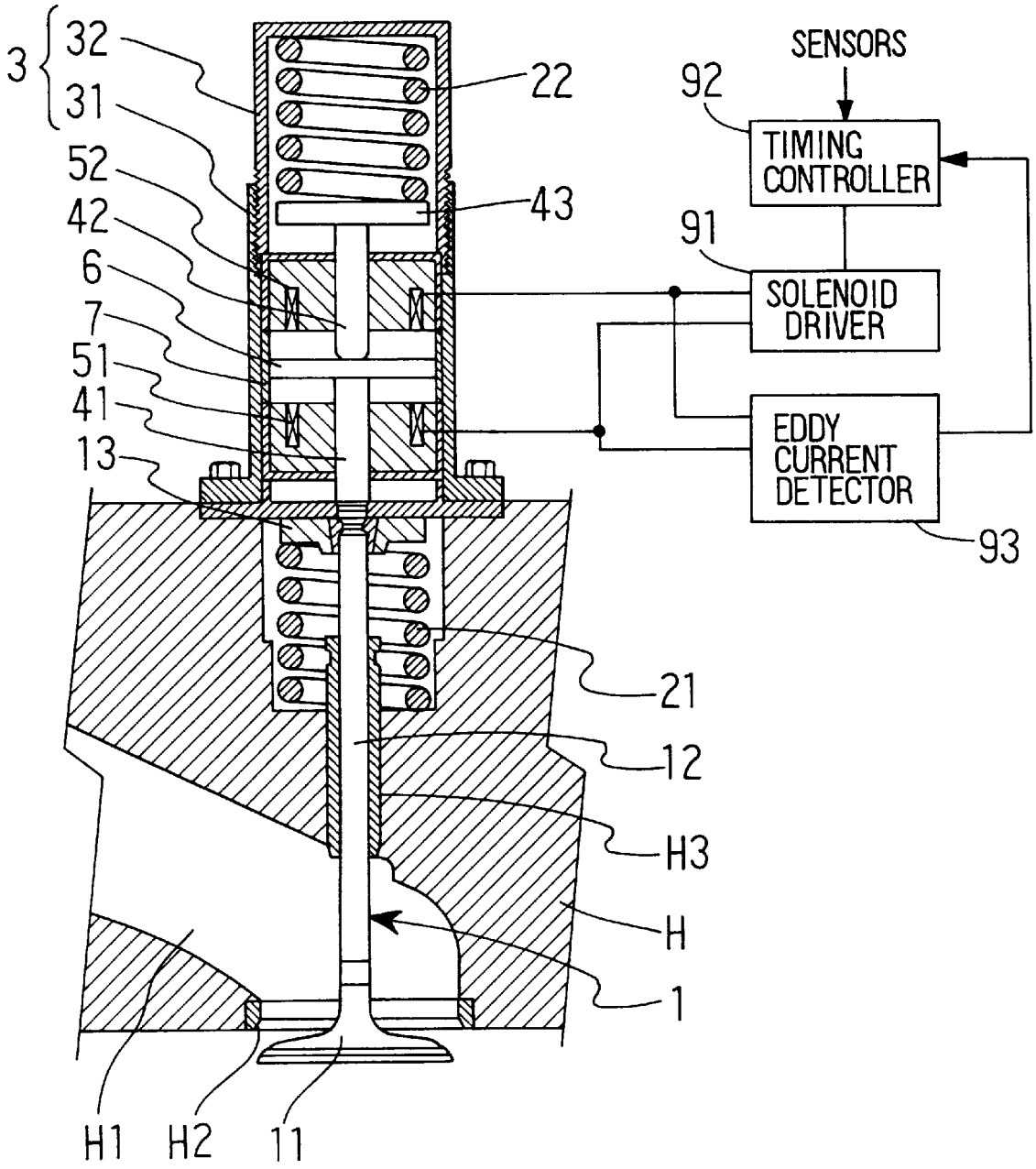
FIG. 13 is a cross-sectional view showing a whole structure of an electromagnetic valve driving apparatus as a first modification of the fifth embodiment.

FIG. 13 shows a first modification of the fifth embodiment, in which the eddy current detecting coil 61 is eliminated, instead, the lower solenoid 51, which is not energized when the the valve is about to close, is utilized as a secondary coil for detecting eddy current representing the valve position. The enegization control of the upper solenoid 52 is performed in the same manner as in the fifth embodiment by the eddy current detector 93. In addition, the eddy current detector 93 is also connected to the upper solenoid 52 to detect the valve position at the vicinity of the open position.

Figure 14:
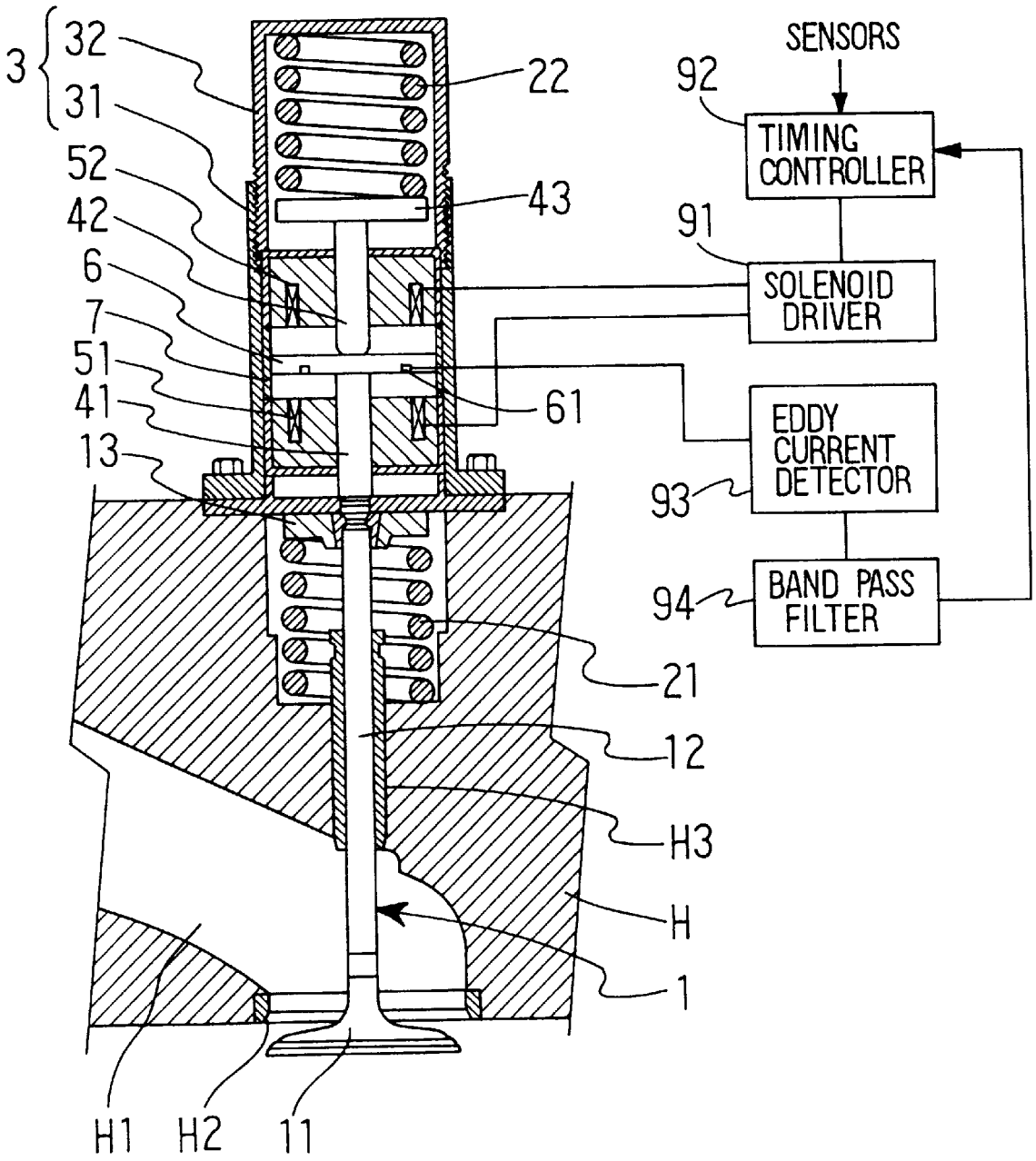
FIG. 14 is a cross-sectional view showing a whole structure of an electromagnetic valve driving apparatus as a second modification of the fifth embodiment.

FIG. 14 shows a second modification of the fifth embodiment, in which a band pass filter 94 is additionally connected to the eddy current detector 93. The band pass filter 94 eliminates noises included in the eddy current signal representing the valve position, and then the eddy current signal is fed to the timing controller 92. The eddy current peak appearing near the closed position is detected more precisely by filtering out the noises.

Figure 15:
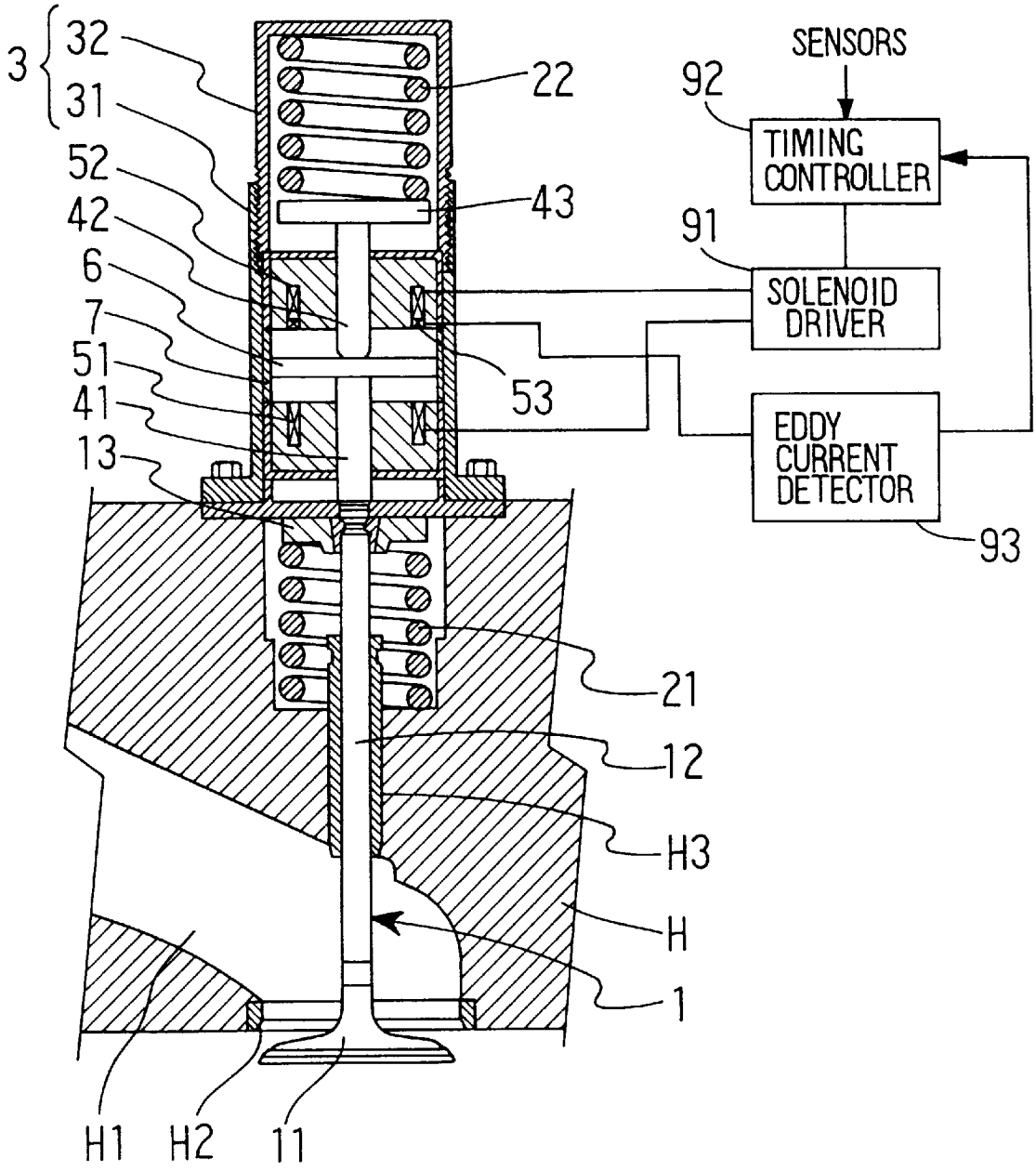
FIG. 15 is a cross-sectional view showing a whole structure of an electromagnetic valve driving apparatus as a third modification of the fifth embodiment.

FIG. 15 shows a third modification of the fifth embodiment, in which the eddy current detecting coil 61 disposed on the armature disc 6 is replaced by an eddy current detecting coil 53. In this modification, the upper solenoid 52 functions as a primary coil and the eddy current detecting coil 53 as a secondary coil in detecting the eddy current generated in the armature disc 6 as a target disc. Since the upper solenoid 52 is energized to close the valve, it is able to function as the primary coil, and the valve position can be detected by the eddy current detecting coil 53. The modification 3 operates in the same manner as in the fifth embodiment.

Figure 16:
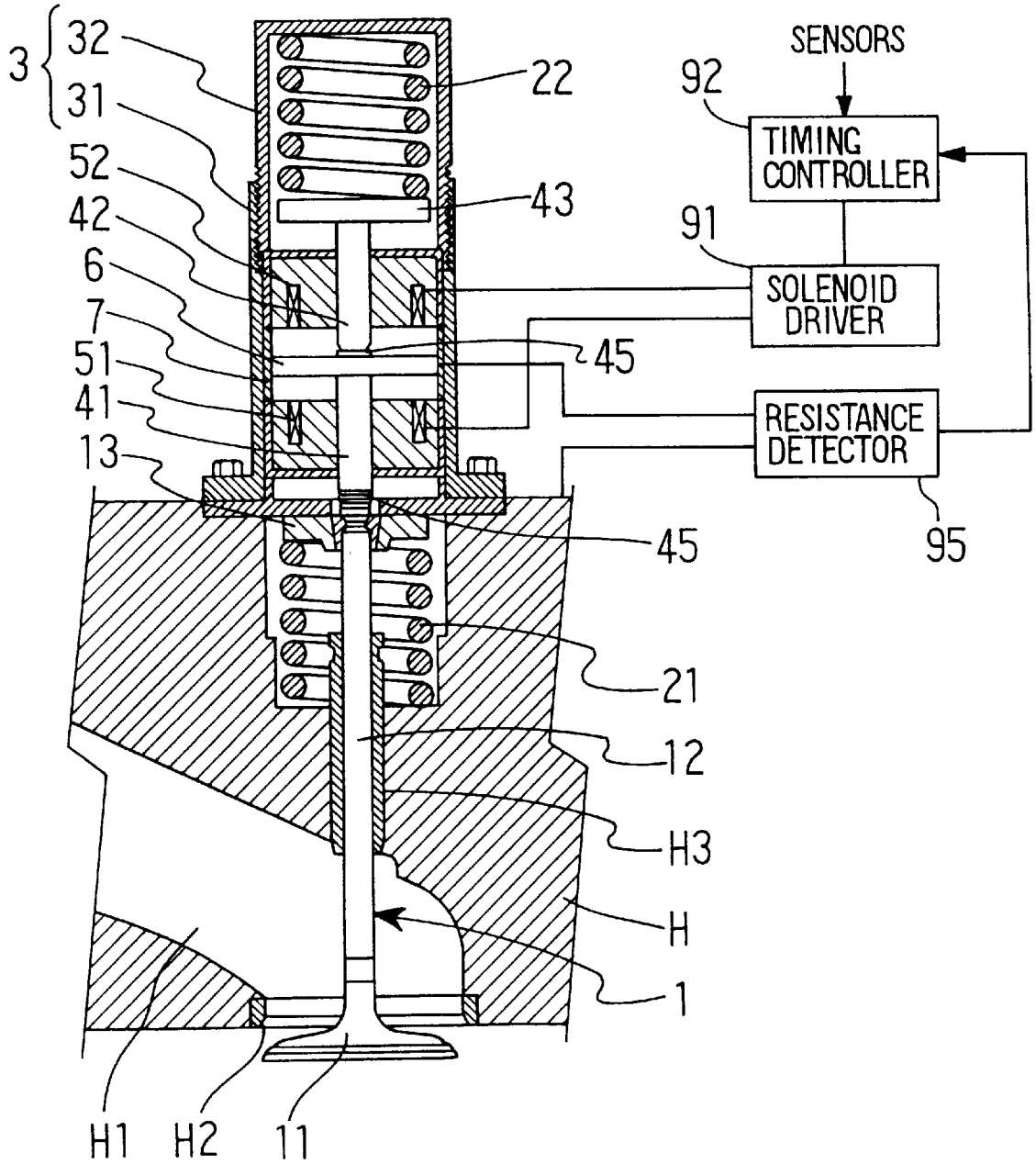
FIG. 16 is a cross-sectional view showing a whole structure of an electromagnetic valve driving apparatus as a sixth embodiment of the present invention.

FIG. 16 shows a sixth embodiment of the present invention. In this embodiment, a resistance detector 95 is used to detect the valve position in place of the eddy current detector 93 used in the fifth embodiment. The resistance detector 95 detects an electrical resistance R between the armature disc 6 and the engine head H which is a sum of the resistances of the armature disc 6, the lower push rod 41, lower solenoid 51 and the engine head H. An insulating sheet 45 is inserted between the armature disc 6 and the upper push rod 42, and another insulating sheet 45 is inserted between the lower push rod 41 and the valve stem 12. As the armature disc 6 approaches the upper solenoid 52 for closing the valve, the resistance R increases because the rod length between the armature disc 6 and the lower solenoid 51 increases, and it becomes the maximum at the closed position. Therefore, the valve position can be represented by the resistance R. The resistance detector 95 feeds the resistance signal to the timing controller 92, and the enegization timing of the solenoids is controlled in the same manner as in the foregoing embodiments.

Figure 17:
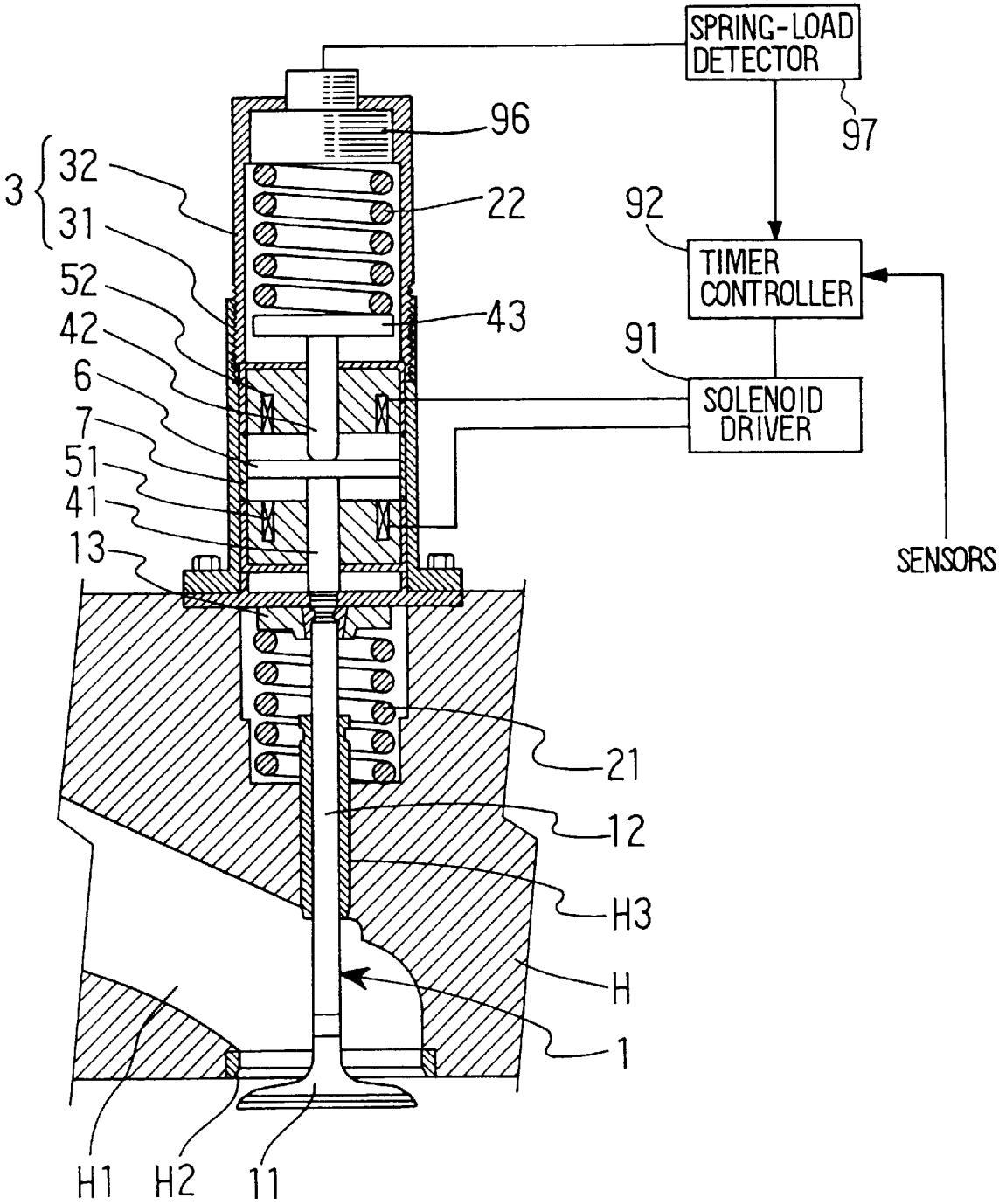
FIG. 17 is a cross-sectional view showing a whole structure of an electromagnetic valve driving apparatus as a seventh embodiment of the present invention.

FIG. 17 shows a seventh embodiment, in which a spring load measuring device 96 is disposed on the top of the upper spring 22. Since the upper spring 22 is compressed or expanded according to the opening or closing operation of the valve, the valve position can be detected by measuring spring load of the upper spring 22. The spring load signal is fed to a spring load detector 97 which in turn feeds its output to the timing controller 92. The energization timing of the solenoids is controlled in the same manner as in the foregoing embodiments.

Though the electromagnetic valve driving apparatus according to the present invention is described as an apparatus for controlling an intake valve of an internal combustion engine in all of the foregoing embodiments, it can be used as an apparatus for controlling an exhaust valve or other valves as well.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An electromagnetic valve driving apparatus comprising:

a valve disposed in a valve body;

a rod connected to the valve for moving the valve between a closed position and an open position thereof;

a first spring biasing the rod toward the closed position of the valve;

a second spring biasing the rod toward the open position of the valve;

an armature connected to the rod;

a first solenoid for closing the valve by attracting the armature thereto upon energization thereof;

a second solenoid for opening the valve by attracting the armature thereto upon energization thereof;

a first chamber formed between the armature and the second solenoid;

a second chamber formed between the armature and the first solenoid; and means for reducing a moving speed of the valve at least at a vicinity of the closed position, wherein said means for reducing the moving speed of the valve comprises a valve position detector for generating an electrical signal representing a valve position; and a solenoid driver for selectively energizing and de-energizing the first solenoid and the second solenoid in controlled timing based on the electrical signal received from the valve position detector, and wherein to drive the valve to the closed position from the open position, the solenoid driver de-energizes the second solenoid so that the valve is moved by said first spring, then, after a first time period determined based on the electrical signal received from the valve position detector, the solenoid driver energizes the first solenoid to exert a force to attract the valve, then, after a second time period determined based on the electrical signal received from the valve position detector, when the valve is at the vicinity of the closed position, the solenoid driver temporarily discontinues energization of the first solenoid, and then, after a third time period determined based on the electrical signal received from the valve position detector, when the valve is at a position where the moving speed of the valve has become substantially zero and before said valve is in said closed position, the solenoid driver again energizes the first solenoid.

2. The electromagnetic valve driving apparatus as in claim 1, wherein:

the valve position detector is an eddy current detector which comprises a target moving together with the rod, a primary coil and a secondary coil, both coils being disposed to face the target; and eddy current representing the valve position generated in the target when the primary coil is energized is detected based on an output of the secondary coil.

3. The electromagnetic valve driving apparatus as in claim 2, wherein:

the eddy current detector is disposed on an upper portion of the apparatus independently from the first and second solenoids.

4. The electromagnetic valve driving apparatus as in claim 2, wherein:

in the eddy current detector, the armature is used as the target, the first solenoid is used as the primary coil, and the secondary coil is wound on the armature.

5. The electromagnetic valve driving apparatus as in claim 2, wherein:

in the eddy current detector, the armature is used as the target, the first solenoid is used as the primary coil, and the second solenoid is used as the secondary coil.

6. The electromagnetic valve driving apparatus as in claim 2, wherein:

the eddy current detector further comprises a filter for eliminating noises contained in the eddy current detected.

7. The electromagnetic valve driving apparatus as in claim 2, wherein:

in the eddy current detector, the armature is used as the target, the first solenoid is used as the primary coil, and secondary coil is additionally disposed on the first solenoid.

8. The electromagnetic valve driving apparatus as in claim 1, wherein:

the valve position detector is a resistance detector which measures an electrical resistance between the armature and the valve body representing the valve position.

9. The electromagnetic valve driving apparatus as in claim 1, wherein:

the valve position detector is a spring load detector which measures a spring load of the second spring representing the valve position.

10. An electromagnetic valve driving apparatus mounted to an engine assembly for selectively opening and closed a port of the engine assembly, comprising:

a valve selectively engaging a valve seat of the port;

a valve stem connected to the valve for moving the valve between a closed position wherein said valve is engaged with the valve seat to close the port and an open position wherein said valve is remote from the valve seat;

a first spring biasing the valve stem and valve connected thereto toward said closed position;

a second spring biasing the valve stem and valve connected thereto toward said open position;

an armature disc mounted to the valve stem;

a first solenoid for attracting the armature thereto upon energization thereof to displace the valve stem and valve connected thereto toward said closed position;

a second solenoid for attracting the armature thereto upon energization thereof to displace the valve stem and valve connected thereto toward said open position;

a valve position detector for generating an electrical signal representing a position of the valve; and a solenoid driver operatively coupled to said valve position detector to receive said electrical signal therefrom, said solenoid driver selectively energizing at least the first solenoid in controlled timing based on the electrical signal received from the valve position detector, wherein the solenoid driver first energizes said first solenoid when the valve is at a first predetermined position intermediate said closed and open positions thereof, then, after a time period t2 determined based the electrical signal received from the valve position detector, when the valve is at a second predetermined position in a vicinity of the closed position, the solenoid driver temporarily discontinues energization of the first solenoid, and then, after a time period t3 determined based the electrical signal received from the valve position detector, when the valve is at a third predetermined position where a moving speed of the valve has become substantially zero, just before a closed position thereof the solenoid driver again energizes the first solenoid.

11. An electromagnetic valve driving apparatus according to claim 10, wherein the solenoid driver first energizes said first solenoid when the valve is at a first predetermined position substantially corresponding to a maximum speed of said valve between said open and closed positions thereof.

* * * * *